US009211004B2

(12) United States Patent
Diemel, Jr. et al.

(10) Patent No.: US 9,211,004 B2
(45) Date of Patent: Dec. 15, 2015

(54) MEDICINE CABINET

(71) Applicant: Kohler Co., Kohler, WI (US)

(72) Inventors: Douglas J. Diemel, Jr., Kohler, WI (US); Benjamin Fullerton, Oconomowoc, WI (US)

(73) Assignee: KOHLER CO., Kohler, WI (US)

( * ) Notice: Subject to any disclaimer, the term of this patent is extended or adjusted under 35 U.S.C. 154(b) by 128 days.

(21) Appl. No.: 13/804,704

(22) Filed: Mar. 14, 2013

(65) Prior Publication Data

US 2014/0265768 A1 Sep. 18, 2014

(51) Int. Cl.
*A47B 67/02* (2006.01)

(52) U.S. Cl.
CPC ..... *A47B 67/02* (2013.01)

(58) Field of Classification Search
USPC ..... 312/242, 245, 224, 225, 226, 227; 108/109; 248/235, 244, 250, 295.11, 248/298.1, 466, 475.1, 222.11
See application file for complete search history.

(56) References Cited

U.S. PATENT DOCUMENTS

| | | | | | |
|---|---|---|---|---|---|
| 418,466 | A | | 12/1889 | Jewett | |
| 569,640 | A | * | 10/1896 | Hartzell | 248/244 |
| 577,204 | A | * | 2/1897 | Patten | 312/213 |
| 720,583 | A | | 2/1903 | Hazzard | |
| 824,026 | A | * | 6/1906 | Jones | 211/190 |
| 2,071,900 | A | | 2/1937 | Procter | |
| 2,166,430 | A | | 7/1939 | Green | |
| 2,199,731 | A | * | 5/1940 | Pryne | 312/310 |
| 2,575,530 | A | | 11/1951 | Reid | |
| 2,752,217 | A | | 6/1956 | Simon | |
| 3,315,932 | A | | 4/1967 | Chandler | |
| 3,404,860 | A | | 10/1968 | Higgins et al. | |
| 3,807,824 | A | | 4/1974 | Hayes | |
| 4,109,434 | A | | 8/1978 | Katzin | |
| 4,537,379 | A | | 8/1985 | Rhoades | |
| 4,572,392 | A | | 2/1986 | Schneider | |
| 4,653,712 | A | | 3/1987 | Murray et al. | |
| 4,720,069 | A | | 1/1988 | Bessinger | |
| 4,736,918 | A | | 4/1988 | Bessinger | |
| 4,799,830 | A | | 1/1989 | Fuss | |
| 4,871,136 | A | | 10/1989 | Bessinger et al. | |
| 4,892,730 | A | | 1/1990 | Hegasy | |
| 5,164,861 | A | | 11/1992 | Katz | |
| 5,277,393 | A | | 1/1994 | Nicholson et al. | |
| 5,662,399 | A | | 9/1997 | Henkel et al. | |
| 6,776,466 | B2 | | 8/2004 | Harvie, III | |
| 7,314,258 | B2 | * | 1/2008 | Sakanoue | 312/139 |
| 8,042,892 | B2 | | 10/2011 | Benz et al. | |
| 8,182,053 | B1 | | 5/2012 | Schacher et al. | |
| 2004/0080249 | A1 | | 4/2004 | Harvie, III | |
| 2005/0040124 | A1 | | 2/2005 | Fontana et al. | |
| 2006/0207957 | A1 | | 9/2006 | Chen | |
| 2007/0013279 | A1 | | 1/2007 | MacMillan et al. | |
| 2010/0320885 | A1 | * | 12/2010 | Chen | 312/237 |

* cited by examiner

*Primary Examiner* — Matthew Ing
(74) *Attorney, Agent, or Firm* — Foley & Lardner LLP

(57) ABSTRACT

A cabinet includes a box with a backboard, a top panel, a bottom panel, and two side panels joining the top and bottom panels. The cabinet further includes shelves configured to be inserted within the box between one pair of clips, each clip having an undulation that mates with a corresponding undulation on trim strips disposed on side panels. An accessory slides in a track of a cabinet door and is connected to the track with a bow clip. The cabinet includes a frame member with a projecting lip configured to extend over an edge of the box. The frame member has at least one stiffening support that connects to a bracket mounted against a wall, and the backboard connects to the bracket with a screw tab having a cover flap concealing a screw. The cabinet is configured to be mounted in a wall surface or a recess.

18 Claims, 12 Drawing Sheets

MEDICINE CABINET

BACKGROUND

The present disclosure relates to improvements for medical cabinets. More particularly it relates to elements to be accommodated in a medicine cabinet that improve the structure and design of the medicine cabinet from both functional and aesthetic perspectives.

Many medicine cabinets have magnifying mirrors that are connected to an interior side of the cabinet door. Additionally, although the magnifying mirrors present in conventional cabinets permit a close-up perspective, such mirrors may be limited by a rigid connection that does not allow the mirror face to be fully adjustable.

Some medicine cabinets may include a magnifying mirror that may be partially adjustable. However, the magnifying mirror is often only configured to connect to the interior of the cabinet door at a predetermined location. Thus, the vertical position of the magnifying mirror cannot be controlled by the user and is instead fixed in one location.

Further, many cabinets have a variety of securing mechanisms to ensure that the cabinet shelves may be in place. These securing mechanisms often employ unsightly hardware. Such hardware is typically metallic and is susceptible to rust and corrosion, particularly in the moisture-rich environment of a typical bathroom.

Shelf support for many medicine cabinets requires physical engagement with the wall to which the medicine cabinet is mounted. Such medicine cabinets generally require holes to be punched in the walls so that the wall directly bears the load of the shelves. Shelf support in such cabinets physically alters the surface of the mounting wall.

If such conventional medicine cabinets are ever removed and replaced, additional labor and materials are needed to conceal the holes used to provide the shelf support. In order to restore the wall to its original appearance, a user must often invest in paint that matches the wall color and finish, spackle to fill in the holes, and suitable tools.

Likewise, the shelves of some medicine cabinets may be fixed at predetermined height increments. Medicine cabinets in which the magnifying mirror or the shelves have predetermined positions may be unsuitable for users of certain heights. Users who intend to place items of particular sizes on each shelf may find that the position of the shelves does not comport with their needs.

Accordingly, there is a need for improvements to medicine cabinets that do not rely on exposed metallic hardware or wall-mounted shelf support systems while providing shelves and adjustable mirrors that can be positioned in accordance with user preference.

SUMMARY

This disclosure provides improvements to a mirrored medicine cabinet including: a shelving support slide-lock clips that allow for adjustment of the shelves without needing to drill holes into the cabinet; an adjustable magnifying mirror; a stiffening screw boss; plastic shelving pins that are reduced in scale, and an extrusion configuration for the cabinet that provides cleanable corners. This disclosure further proves an improved method of installation a medicine cabinet that permits the cabinet to be easily removed, mounted in a recess or on a surface without different hardware; and flipped upside down.

In preferred embodiments, a shelving support slide-lock clips that allow for adjustment of the shelves without needing to drill holes into the cabinet. In at least one embodiment, the clips snap into a vertical trim slot behind the mirror. Some embodiments of the claimed invention include clips that are shaped like rakes, that is, having a longer portion corresponding to a stem of the rake and a shorter portion corresponding to a head of the rake. In at least one embodiment, the clips are formed of injection-molded plastic. The shape of the clip in some embodiments features a longer rectilinear portion with which a shorter rectilinear portion forms a T-junction; i.e., the shorter portion is perpendicular to and bisected by the longer portion.

In at least one embodiment, the clips are held in place by mating a plurality of undulating formations on the rake head (i.e., the shorter portion) with a trim strip of the vertical trim slot. In at least one embodiment, the trim strip has a plastic insert that has a corresponding undulating pattern to permit alignment with the undulating formations of the shorter portion of the clips. The shorter portion is further provided with a slot that imparts a tactile sensation of snapping in and snapping out when the shorter portion is engaged or disengaged respectively with the trim strip.

In preferred embodiments, a cabinet door has a frame with a track for the magnifying mirror that allows it to slide up and down the door frame. The magnifying mirror can be flush with the door so that when it is not in use it does not interfere with closing the door. In at least one embodiment, the magnifying mirror is connected to the frame of the cabinet door by a bracket that permits the mirror to be rotated from a stowed position outwardly to a deployed position when the magnifying mirror is in use. A mirror slide mechanism uses a flat clip that bows and binds so that it can be pushed in and released to adjust the height of the mirror. Outer edges of the flat clip include flat bearings to permit sliding. In some embodiments, the flat clip has a metal or copolymer spring. At least one embodiment has two flaps holding the magnifying mirror to the flat clip.

Some embodiments of the present disclosure relate to improvements for a medicine cabinet including a screw boss added along the length of top and bottom panel extrusions. The screw boss serves as a stiffener and provides rigidity to help prevent sagging. The screw boss imparts an advantageous effect particularly for longer panels that would otherwise undergo greater deflection. For additional rigidity, some embodiments include a back board that abuts a back face of the medicine cabinet in proximity to the wall.

In some embodiments, a plurality of pins are capable of securing a shelving system of the cabinet. In preferred embodiments, such pins require holes that do not exceed three millimeters in diameter to be drilled into side walls of the cabinet. The reduced size of the pins achieves a more aesthetically pleasing cabinet. Preferred embodiments feature plastic pins; however, other embodiments may use pins made from at least one of a plurality of alternative materials, including composite materials.

In preferred embodiments of the claimed invention, an extrusion is formed to permit top and bottom panels of the cabinet to form cleanable corners. Unlike conventional medicine cabinets having a flat top and a flat bottom, preferred embodiments have curved corners on top and bottom panels to prevent liquids and debris from accumulating at edges of the mirror. In some embodiments, the extrusion has a front lip extending over the mirror edge and has a recess for two-sided tape. The extrusion thus allows the mirror to be secured without the tape being visible to a user. The extrusion further inhibits moisture from forming behind the mirror and inhibits mildew. Preferred embodiments with cleanable corners enable users to easily and efficiently clean their medicine cabinets. Further, the cleanable corners serve to prevent desilverization of mirrored surfaces of the cabinet.

In some embodiments, improvements for a medicine cabinet include extrusions on back edges of the top and bottom panel with slots to receive slide-in clips. Some embodiments use slots to receive slide-in clips that may resemble so-called "French cleat" configurations or the like. A top slide-in clip mounts onto a wall bracket and the weight of the cabinet holds the bottom against the wall. Slide-in tabs with holes are slid into an extrusion on the bottom panel and are screwed to the wall. In at least one embodiment, the slide-in tabs have a snap-over cover to cover the heads of the screws. In one embodiment, the slide-in clips are formed of plastic. In another embodiment, the slide-in clips are made of aluminum. Alternative embodiments include slide-in clips made of natural, synthetic, or composite materials.

In at least one embodiment, a larger front flange allows for greater variation in the size of the opening. The larger front flange of some embodiments achieves enhanced rough-in capability. In at least one embodiment, a magnifying mirror or other accessories may be interchangeably installed in the frame of the cabinet door. In embodiments with a magnifying mirror and in embodiments where an accessory may be installed in lieu of a magnifying mirror, a door frame of the cabinet permits the magnifying mirror or accessory to be stowed away within the door profile, so as not to interfere with objects in the cabinet. In some embodiments, the door has a slow-close hinge. In some embodiments, an under-hanging shelf with a tray for removing objects is disposed on a lower end of the medicine cabinet and is not covered by the door.

Some embodiments of the present disclosure relate to an improved installation method for the medicine cabinet. The cabinet in at least one embodiment can be mounted into an opening in a wall using a recess mount. Alternatively, in other embodiments, the cabinet can also be surface mounted so that a back of the cabinet is mounted against a wall, and trim strips can be snapped on to cover open sides (i.e., behind the flanges). In at least one embodiment, a method of installation positions the cabinet in an upside-down position in which the cabinet is "flipped" for use as an opposite-hand cabinet. In such an embodiment, the position of the bracket and tabs are switched. The cabinet may be easily removed from either a recess mount or a surface mount. Installation does not require different hardware depending on whether the cabinet is recess-mounted or surface-mounted; i.e., the same hardware may be used in either installation.

These and still other advantages of the invention will be apparent from the detailed description and drawings. What follows is merely a description of at least one embodiment of the present invention. To assess the full scope of the invention, the claims should be looked to as the embodiments are not intended to be the only embodiments within the scope of the claims.

DETAILED DESCRIPTION

Some embodiments of an improved medicine cabinet include such inventive improvements as at least one pair of shelving support slide-lock clips, an adjustable accessory such as a magnifying mirror, a shelving system using reduced-scale pins, and innovative mounting devices for top and bottom panels of a cabinet box. A shelving system includes the shelving support slide-lock clips and is configured to obviate the need for holes to support shelves within a cabinet box. The shelving support slide-lock clips replace shelving supports that require punched holes, and snap into a trim slot of a frame of the cabinet box. The adjustable magnifying mirror is integrated with a track in a door frame of the cabinet that permits the mirror to selectively slide up and down. Each of a top panel of the cabinet box and a bottom panel of the cabinet box has an innovative mounting device formed by a suitable process such as extrusion to provide a frame member with connection and rigidification features. The frame member has a front lip that extends over an edge to provide for retention and edge sealing of a non-magnifying mirror. The frame member has a connection feature shown as a screw boss for connecting side panels to the top and bottom panels, and that also provides rigidity and prevent sagging in the cabinet structure. In some embodiments, the frame member also services as a mounting strip. The mirror is affixed using two-sided tape that is not visible to a user. Additionally, a mounting bracket in at least one embodiment is configured to secure the magnifying mirror while concealing hardware from a user. Some embodiments relate to an underhanging shelf positioned lower than the cabinet door to permit display or access to certain articles without needing to open the door. At least one embodiment relates to an improved installation hardware and method providing for a cabinet to be easily recess mounted or surface mounted. The method also provides for the cabinet to be easily removable and to be installed or reconfigured as an upside-down opposite-hand cabinet.

Figure 1:
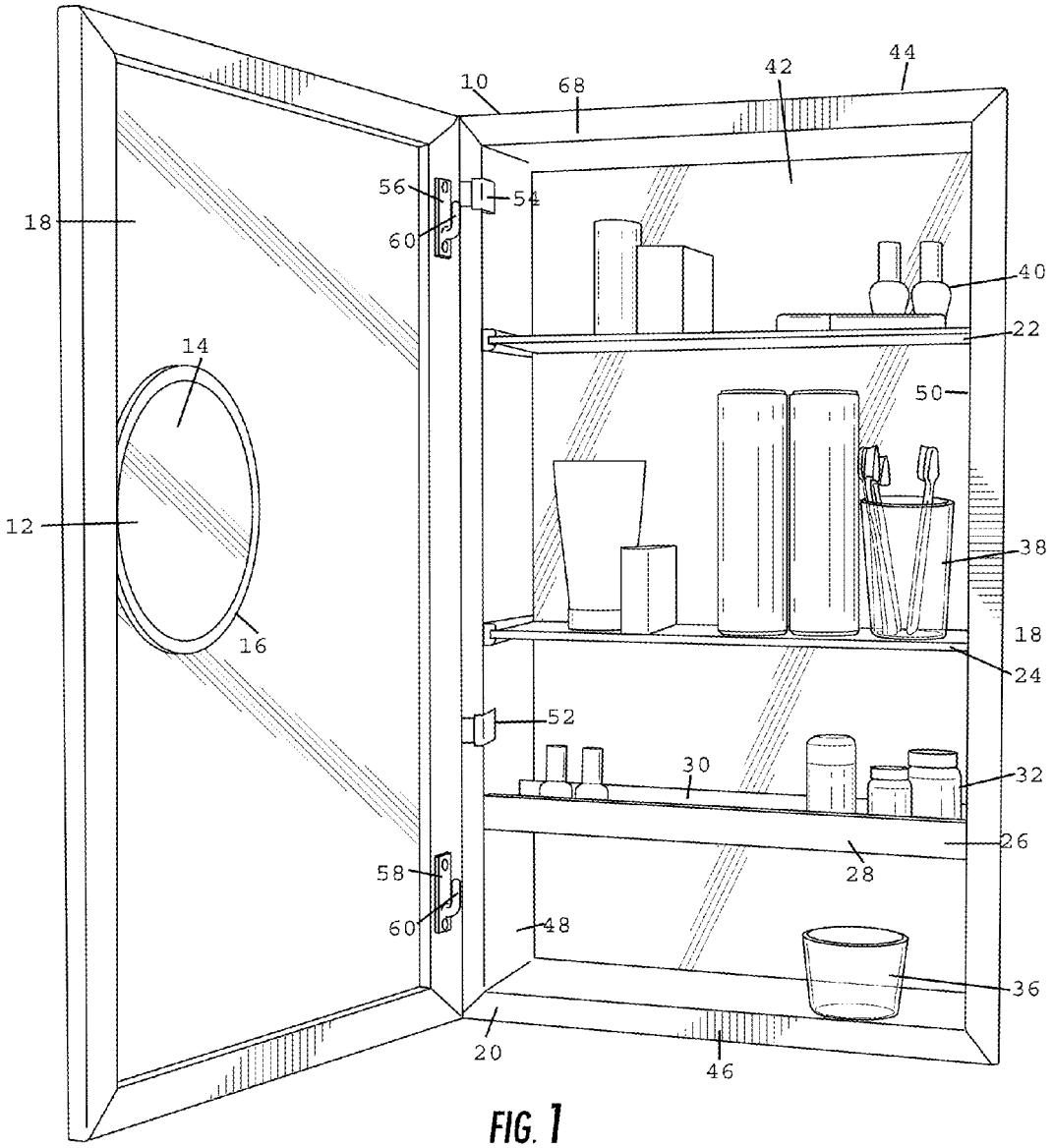
FIG. 1 is a perspective view of an embodiment of a medicine cabinet including inventive improvements.

FIG. 1 depicts an embodiment of a medicine cabinet 10 with an inventive improvement relating to a magnifying mirror 12 with a mirrored surface 14 and a rim 16. FIG. 1 depicts the magnifying mirror 12 connected to a cabinet door 18, which is connected to a cabinet box 20. The cabinet box 20 features a plurality of flat shelves 22 and 24. The cabinet box 20, in some embodiments, can feature a pocket-like shelf 26 with a retaining wall 28 and a recessed channel 30 for storing items including medicaments 32. The flat shelves may store a plurality of items of varying sizes such as a cup 36, a toothbrush holder 38 or a bottle 40. The cabinet box 20 has a backboard 42 that serves as a back panel. The cabinet box 20 further includes a frame 68 including boundary panels 44, 46, 48, and 50 along the top, bottom and lateral sides respectively, surrounding the back panel 42. Hinges 52 and 54 connect the cabinet door 18 to the box 20. In some embodiments, the door may have hinge plates 56, 58 with projecting portions 60.

Figure 2:
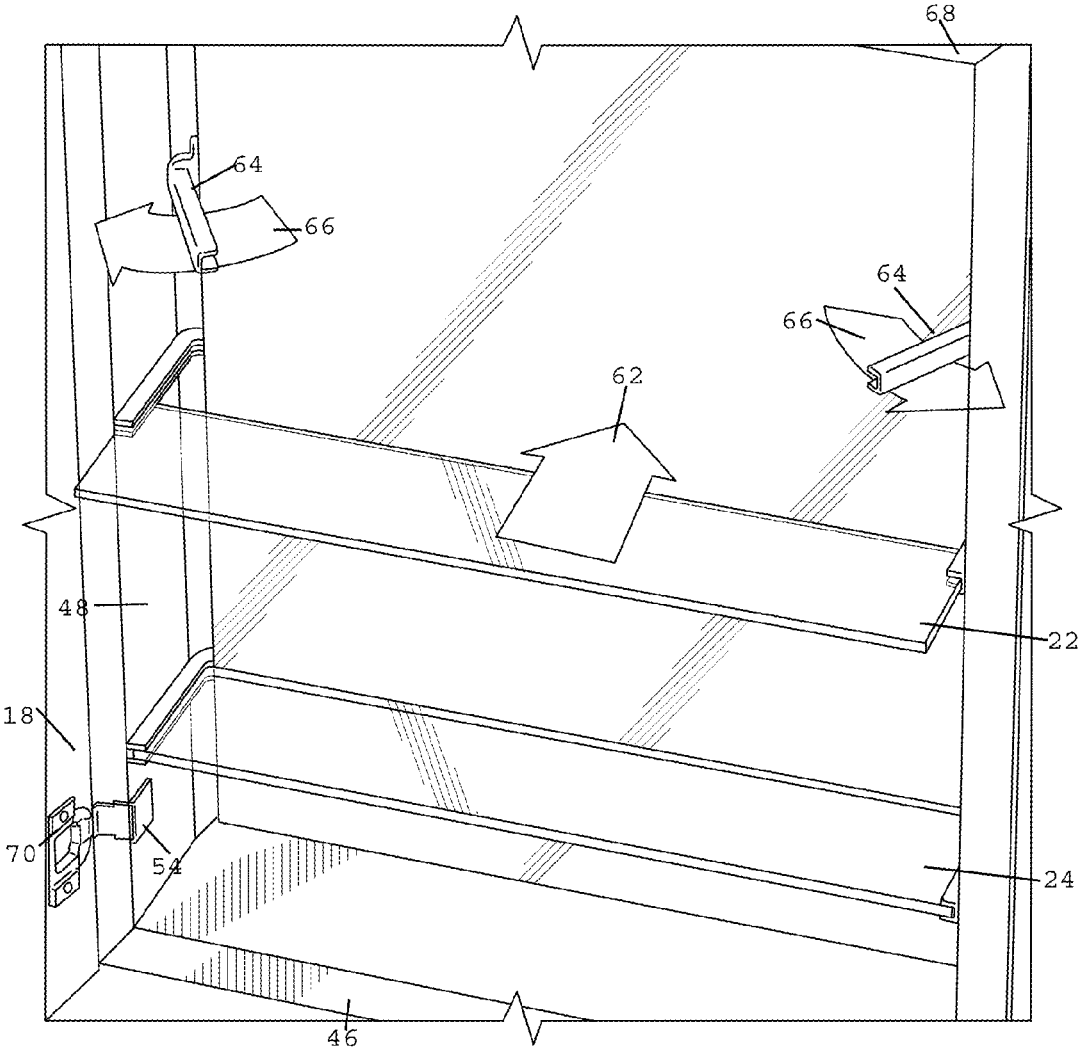
FIG. 2 is a partial perspective view of an interior of the medicine cabinet of FIG. 1.

Referring to FIG. 2, shelves 22, 24 may slide into the box of the medicine cabinet as depicted in the direction of movement shown by the arrow 62. In order to facilitate easy installation and height adjustment of the shelves, at least one pair of side clips 64 is disposed along opposite sides of each shelf 22, 24. The side clips 64 are readily inserted into the box of the medicine cabinet in the direction of movement depicted by arrows 66. The shelves parallel the bottom panel 46 of the frame of the box. A first hinge 54 on one of the side panels 48 of the frame 68 joins to a second hinge portion 70 on the door 18 of the cabinet.

Figure 7A:
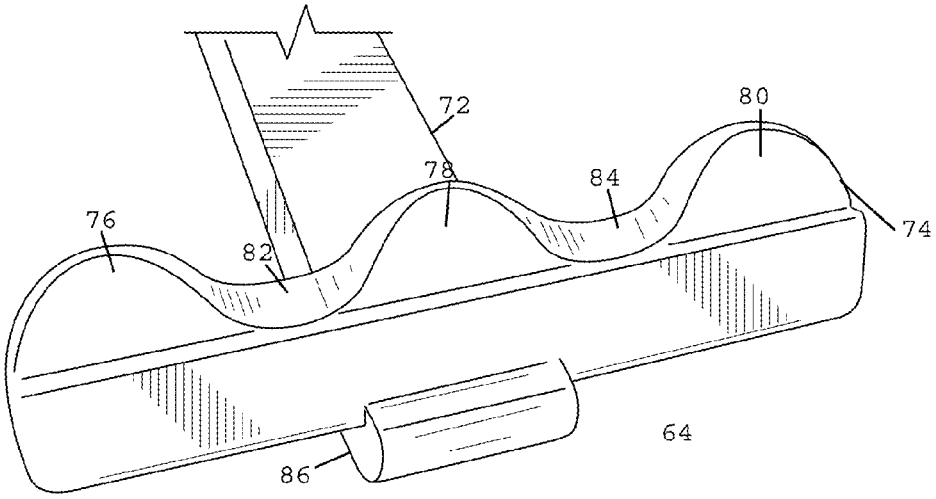
FIG. 7A is a partial perspective view of a head portion of a clip for shelf support in the medicine cabinet of FIG. 1, according to an exemplary embodiment.

Referring more particularly now to FIGS. 7A-D, FIG. 7A depicts further details of slide clip 64 of the at least one pair of clips. The clip 64 for shelf support has a linear section 72 forming a body and an undulating section 74 (e.g. in the shape of a sine wave or other shape with peaks and valleys) forming a head. In some embodiments, the clip has a "rake-like" shape. FIG. 7A depicts the undulating section 74 having a plurality of undulations formed by peaks 76, 78, and 80 and indentations 82 and 84 between the peaks. In some embodiments, the linear section 72 that forms the body of the clip 64 has a length 86 that extends past the undulating section 74. The plurality of undulations match a corresponding row of undulations on a trim strip (not shown) of a side panel of the cabinet box, so that the clip is adjustably positioned to a desired height and then snaps against the trim strip positioned on side panels of the shelves when rotated as shown by arrow 66.

Figure 7B:
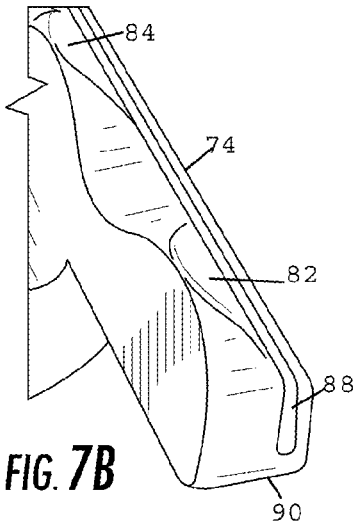
FIG. 7B is a partial side perspective view of a head portion of a clip for shelf support in the medicine cabinet of FIG. 1, according to an exemplary embodiment.
Figure 7C:
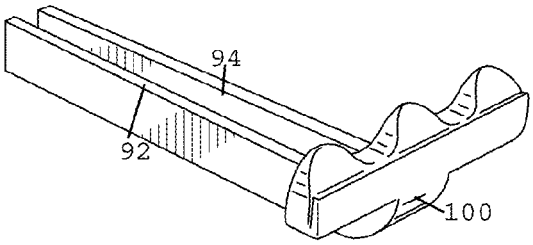
FIG. 7C is a front right perspective view of a clip for shelf support in the medicine cabinet of FIG. 1, according to an exemplary embodiment.
Figure 7D:
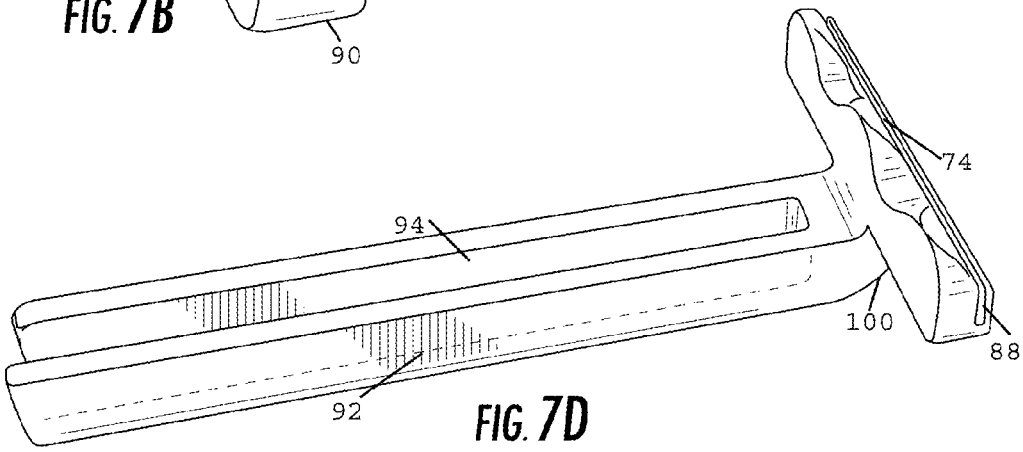
FIG. 7D is a side perspective view of a clip for shelf support in the medicine cabinet of FIG. 1, according to an exemplary embodiment.

FIG. 7B depicts the undulating section 74 of the head of the clip including indentations 82 and 84. In some embodiments, indentations 82 and 84 abut a groove 88 in the undulating section. FIG. 7B depicts a width 90 of the undulating section 74 of the clip. In some embodiments, the clips may be translucent hard plastic. FIG. 7C depicts an embodiment of the clip with a rake-like body portion defined by walls 92 and 94 and a curved terminus 100 that culminates in the head portion 74 rather than extending beyond the head portion. FIG. 7D depicts an embodiment of the clip in which the terminus 100 is shown to curved upward into the undulating section 74.

Figure 8A:
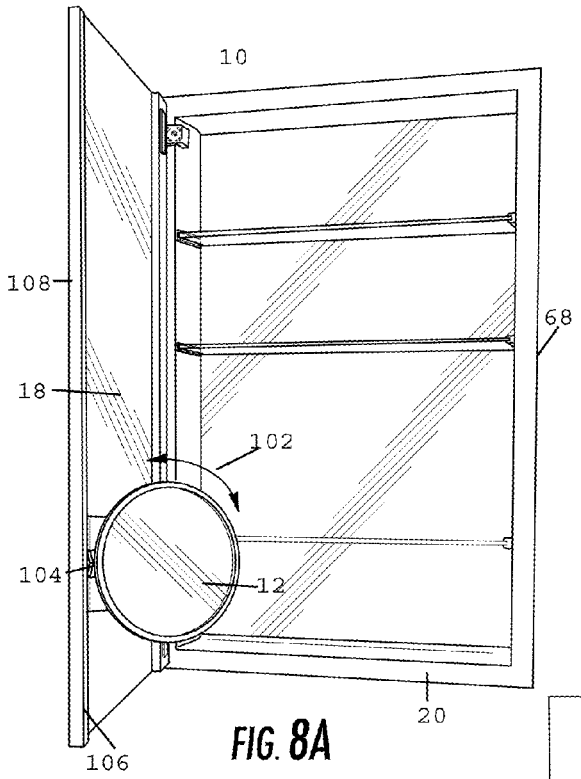
FIG. 8A is a perspective view of the medicine cabinet of FIG. 1 with the door in an open position and including an accessory, according to an exemplary embodiment.
Figure 8B:
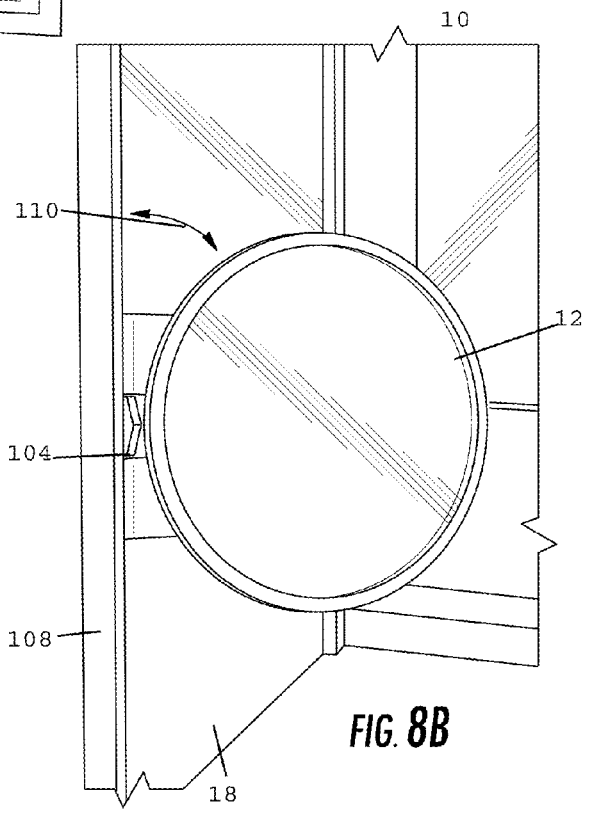
FIG. 8B is a detailed view of the door and accessory of FIG. 8A, according to an exemplary embodiment.

Referring more particularly now to FIGS. 8A-B, 9 and 10A-D, an embodiment of a cabinet 10 in which an accessory, shown as a magnifying mirror 12, is movable between a stowed position and a deployed position by rotating in the direction of arrows 102 from the cabinet door 18. The magnifying mirror 12 is positioned with a bow clip 104 to a frame edge 108 of the cabinet door 18. The magnifying mirror 12 sits in a track 106 along frame edge 108 of the cabinet door 18 such that it can slide vertically along the track. The bow clip 104, which may also be referred to as an actuatable clip, can be pushed inwardly to allow for height adjustment and released to secure the mirror in place. When the cabinet door is opened, the magnifying mirror 12 may be deployed outwardly from cabinet box 20 for use. When the cabinet door is closed, the magnifying mirror may be stowed inwardly in the direction of cabinet box frame 68. FIG. 8B depicts an embodiment of a cabinet 10 in which a magnifying mirror 12 is turned in the direction of arrows 110 into or away from the cabinet door 18. It can be appreciated that the mirror 12 can be stowed in a low-profile manner alongside frame edge 108 within the cabinet 10 so as not to interfere with items on the shelves.

Figure 9:
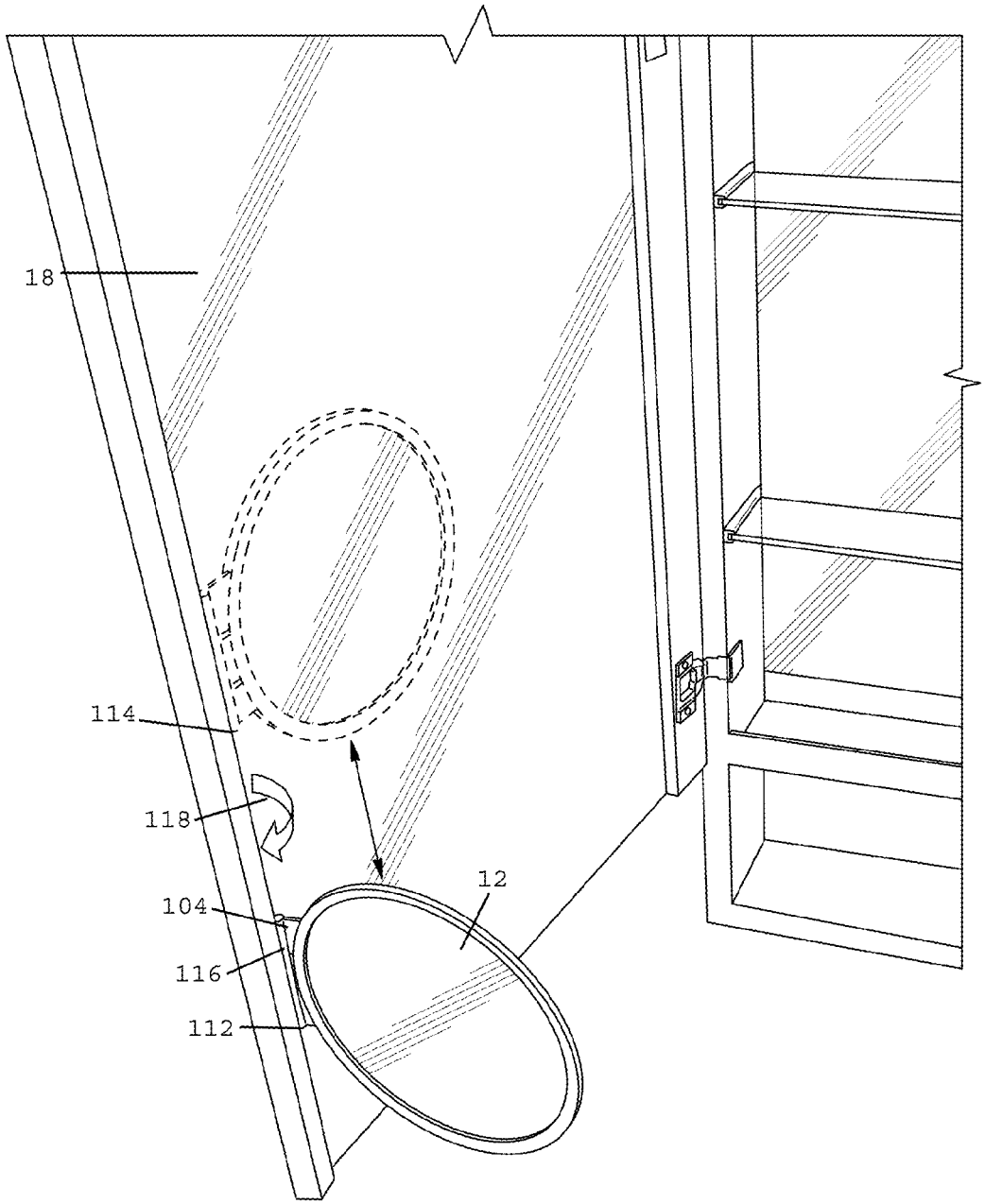
FIG. 9 is a partial view of the door and accessory of the medicine cabinet of FIGS. 8A-B and movable in various positions, according to an exemplary embodiment.

FIG. 9 depicts an embodiment of a medicine cabinet in which the door 18 features the magnifying mirror 12 positioned at a plurality of heights in accordance with user preference by sliding along the track 106 (not shown). The magnifying mirror 12 may be positioned vertically by sliding a rod 116 of the bow clip 104. Bow clip 104 includes a flat spring or the like that can be engaged (e.g. by pressing, etc.) to release the clip and slide on the track. The spring is then disengaged or released to bind on the track and secure the mirror in place. For example, the mirror 12 may be positioned at a first position 112 or a second position 114. The mirror turns outward in the direction of arrow 118. The mirror may be stowed flat to be flush against the door 18.

In some embodiments of a medicine cabinet, a magnifying mirror is installed such that no unsightly hardware is revealed. The hardware used to install the magnifying mirror is simple and allows the magnifying mirror to be initially positioned and subsequently repositioned easily, with a minimum of strength.

Figure 10A:
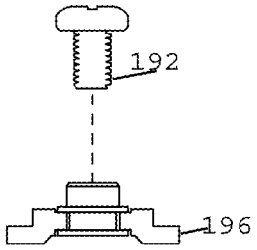
FIG. 10A is a front view of a screw and a receiving portion for an adjustment mechanism in the medicine cabinet of FIG. 1.
Figure 10B:
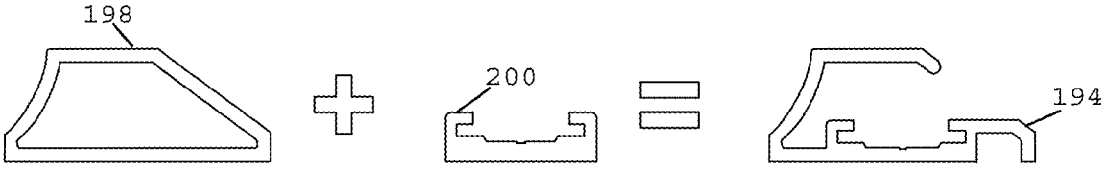
FIG. 10B is a cross-sectional view of a structure for an adjustment mechanism in the medicine cabinet of FIG. 1.
Figure 10C:
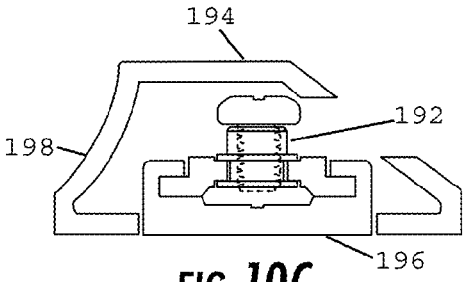
FIG. 10C is a cross-sectional view of an adjustment mechanism in the medicine cabinet of FIG. 1.
Figure 10D:
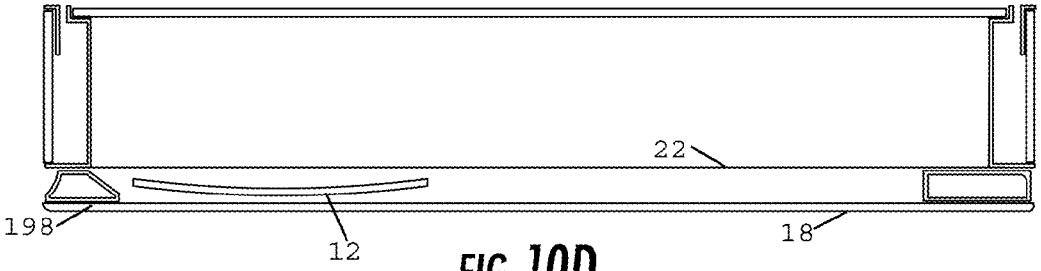
FIG. 10D is a cross-sectional view of an adjustment mechanism and magnifying mirror of the medicine cabinet of FIG. 1.

As shown in FIGS. 10A-10D, at least one embodiment relates to an improved connection for the magnifying mirror 12. One embodiment uses at least one slide in tab 190 with a hole for fixation to the wall via a screw 192. The slide in tab has a snap cover 194 to cover the screw 192 received in a receiving structure 196. FIG. 10B depicts structural formation of an embodiment of the improved cover 194 for a magnifying mirror formed by a first structure 198 and a second structure 200. As shown in FIG. 10C, a second engaging portion 198 receives the structure 196 into which the screw 192 is received. In some embodiments, the receiving structure 196 is a chuck. FIG. 10D depicts an embodiment in which the first structure 198 is connected to a magnifying mirror 12 stowed against a cabinet door 18. A gap exists between the door 18 and a shelf 22.

Figure 4A:
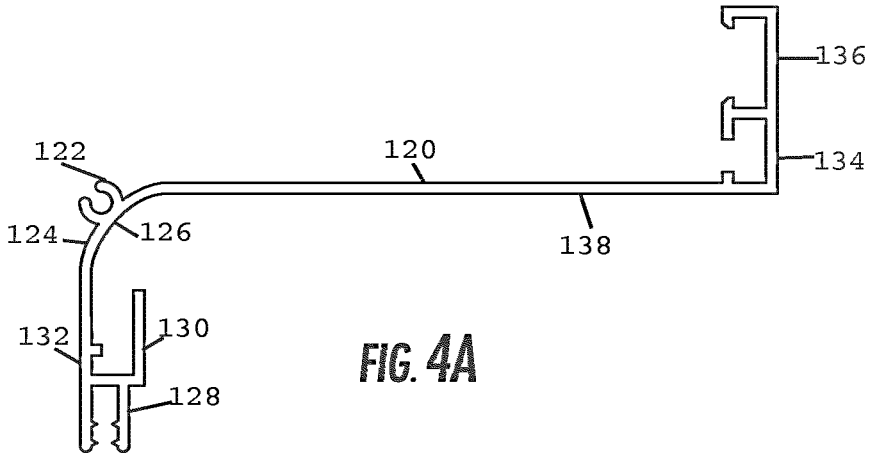
FIG. 4A is a cross-sectional view of a panel member for a frame of the medicine cabinet of FIG. 1, according to an exemplary embodiment.
Figure 4B:
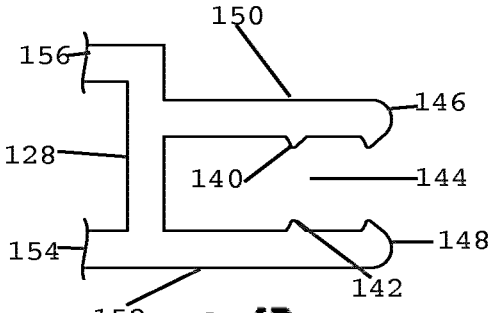
FIG. 4B is a detailed cross-sectional view of a portion of the panel member of the embodiment of FIG. 4B, having a press fit to retain a back board of the medicine cabinet.

Referring now to FIGS. 4A-B, 5 and 6, a cross sectional illustration of one embodiment for frame members for use in constructing the top, bottom and side walls that make-up the frame for the cabinet are shown according to an exemplary embodiment. As shown in FIG. 4A-B, a frame member 120, which may be formed in any suitable extrusion process, for example, includes a shape defining a screw boss 122 on a curved portion 124 with a radius of curvature 126 and a crimped receptacle portion 128 with a rectilinear segment 130 and a hook 132. The crimped receptacle portion 128 forms a first terminal of the frame member, with the second terminal formed by two areas 134, 136 may, at its edges, define corner clips for mitered corners of the mirror for joining the top, bottom and side frame members to one another. In one embodiment, the frame members have a depth 138 positioned between the crimped press portion and the second terminal, which corresponds generally to the desired depth of the cabinet.

Figure 5:
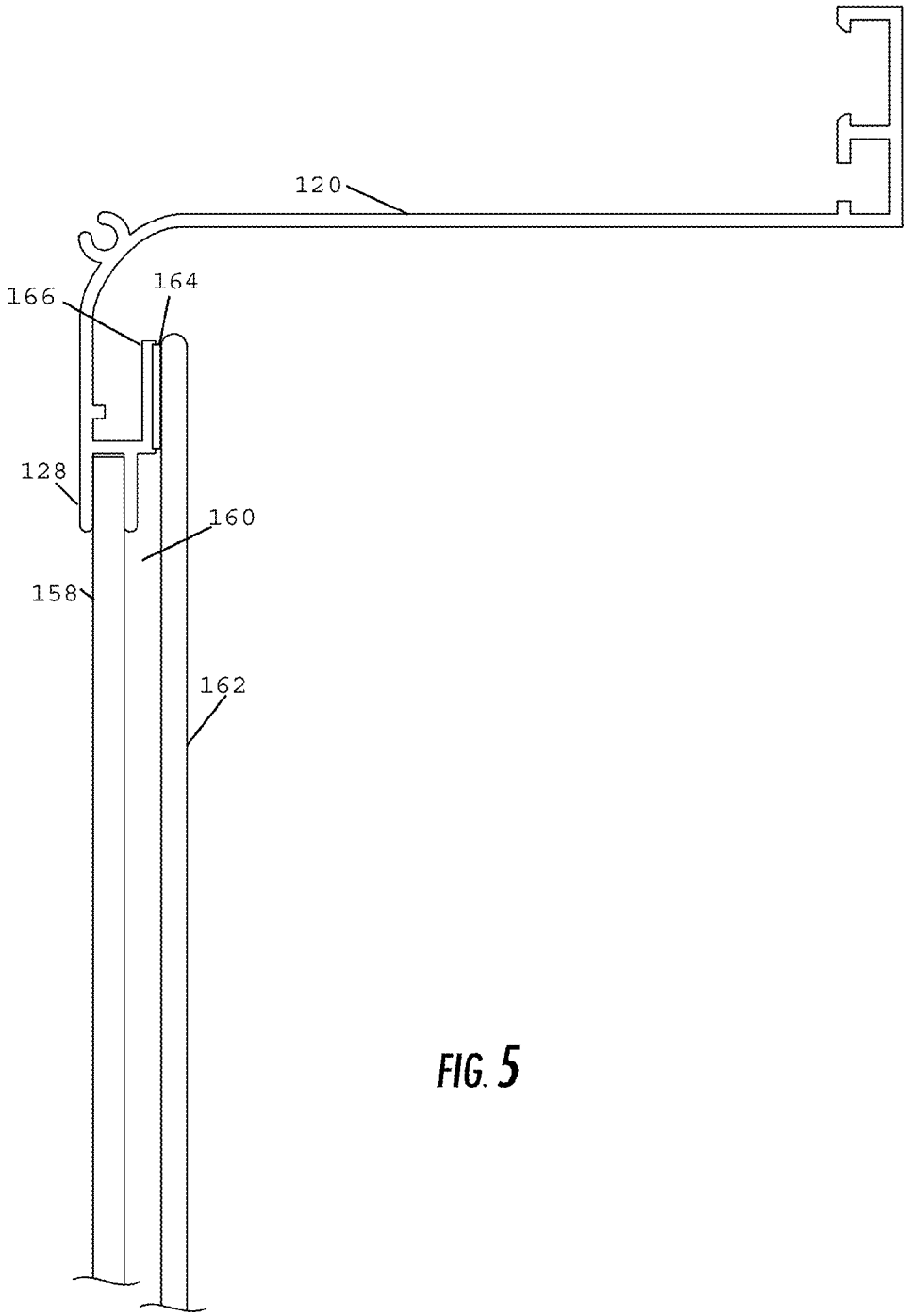
FIG. 5 is a cross-sectional view of the panel member for a cabinet of FIG. 4A-B, having a back panel and mirror panel coupled thereto, according to an exemplary embodiment.

In some embodiments, a press portion of the frame member may be fitted against a wall bracket such that the weight of the cabinet is supported safely via screw boss 122. As shown in FIG. 4B, the press portion 128 has teeth 140 and 142, a recess 144, ends 146 and 148, and sides 150 and 152. Extending segments 154 and 156 join the frame members 120 shown in FIG. 4A. FIG. 5 depicts an embodiment in which one of the frame members 120 has a backboard material 158 for the back of the cabinet box between the teeth of the crimped press portion 140, 142 such that the teeth are concealed. An air gap 160 exists between the backboard 158 and material for a box interior 162. In some embodiments, the material 162 is mirrored glass. Some embodiments feature an adhesive 164 positioned to connect to the crimped press portions of the frame members 120. The adhesive of some embodiments is high bond tape. The frame members 120 are configured to conceal the adhesive 164 such that the adhesive 164 is not visible to a user. The frame member has a lip 166 that extends over an edge of the mirror for concealment of adhesive tape 164.

Figure 6:
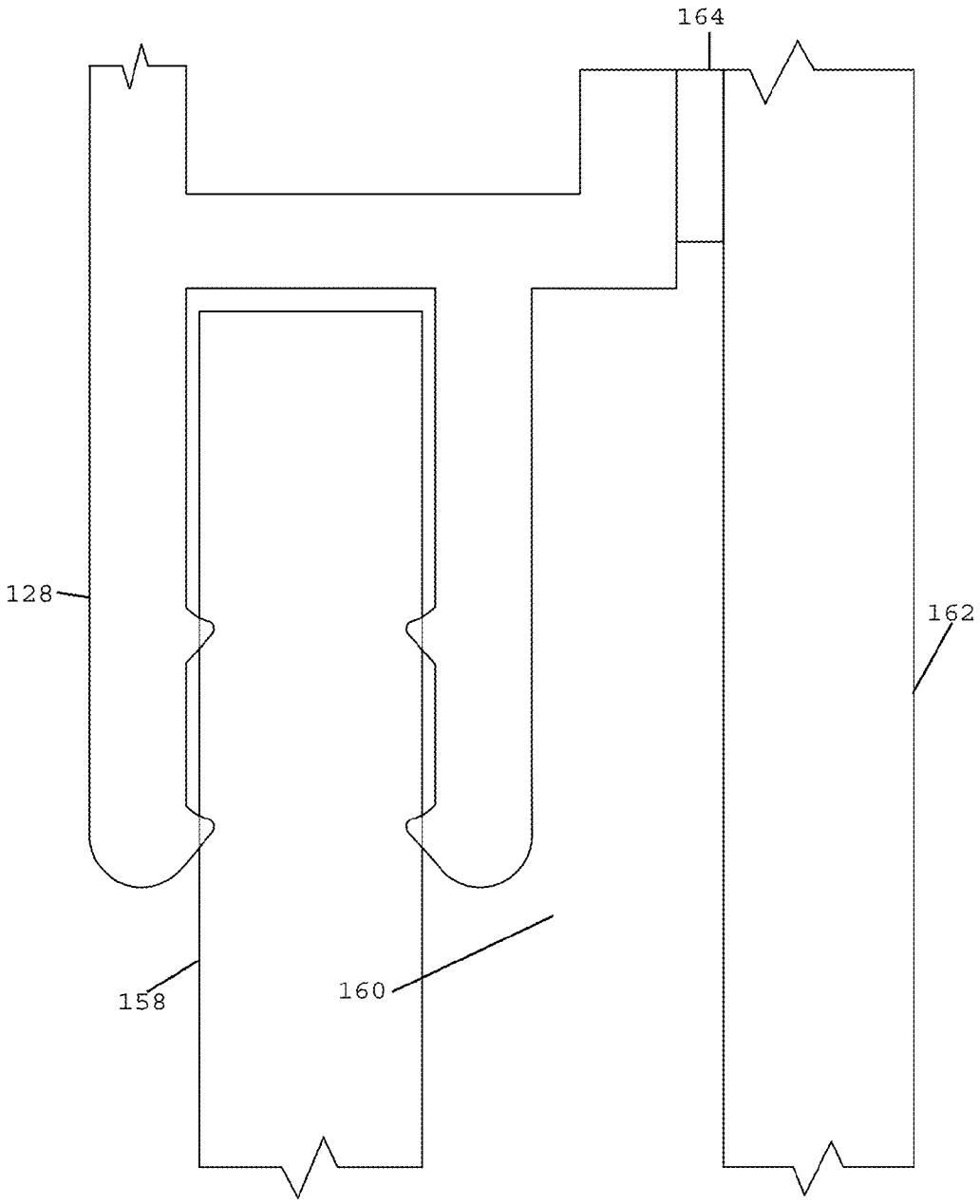
FIG. 6 is a sectional view of the back board and press fit of the medicine cabinet of FIG. 5, according to an exemplary embodiment.

FIG. 6 depicts the crimped press portion 128 with a backboard 158 positioned such that the air gap 160 exists between the backboard 158 and an interior material 162. Double adhesive tape 164 is inserted in a recess of some embodiments to connect the interior material to the press portion. The material for the backboard may be a hardboard such as a composite material. The hardboard provides structural firmness to the cabinet box and protects it from damage. In some embodiments, the material may be plywood. The air gap 160 is intended to reduce damage from impacts to a back of the cabinet box.

Figure 11A:
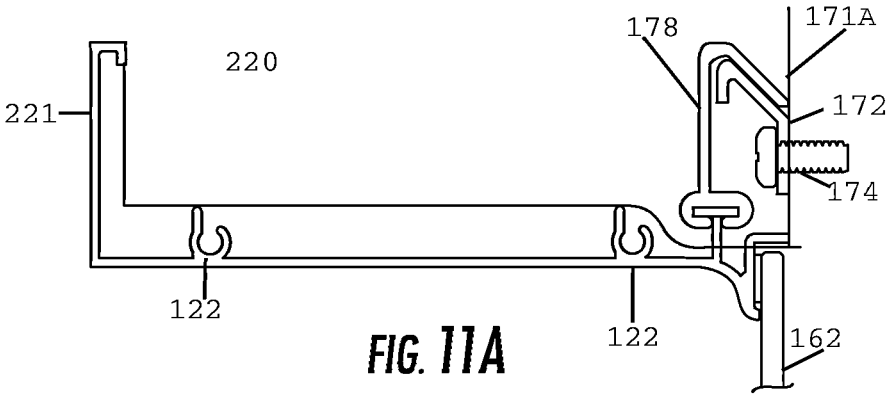
FIG. 11A is a cross-section of a top panel for a frame member of the medicine cabinet of FIG. 1, according to an exemplary embodiment.
Figure 11B:
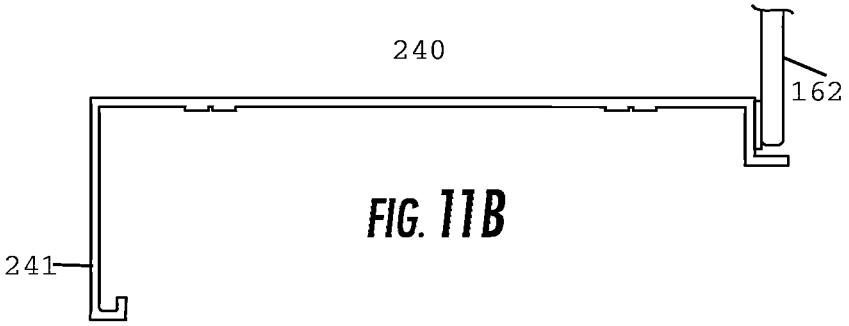
FIG. 11B is a cross-section of side panels for a frame member of the medicine cabinet of FIG. 1, according to the embodiment of FIG. 11A.
Figure 11C:
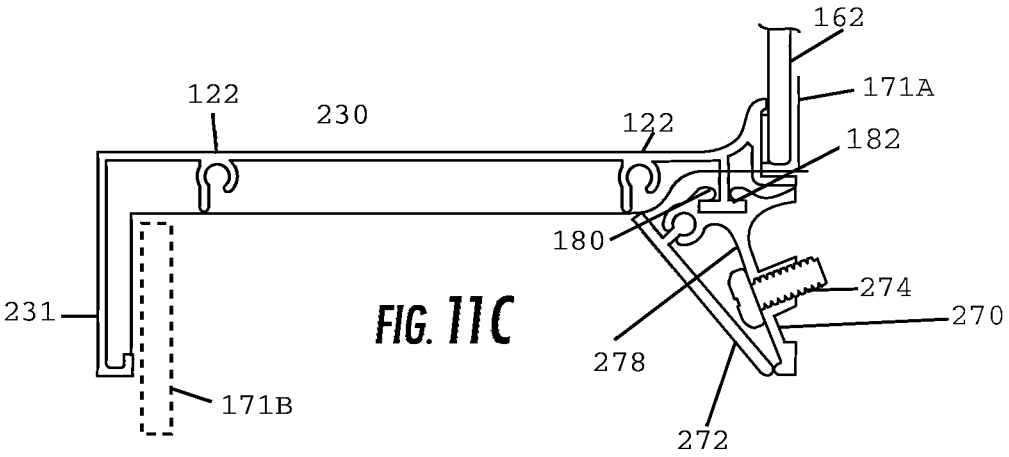
FIG. 11C is a cross-section of a bottom panel for a frame member of the medicine cabinet of FIG. 1, according to the embodiment of FIG. 11A.

Referring now to FIGS. 11A-C, improved mounting hardware for a cabinet that also provides increased support and rigidity is shown according to another exemplary embodiment. FIGS. 11A-11C depict embodiments of improvements for a medicine cabinet, including top (FIG. 11A), bottom (FIG. 11C), and lateral side panels (FIG. 11B) 220, 230, 240 connecting to an interior material 162 (e.g. mirror back panel, etc.) in a cabinet interior. The panels feature at least one screw boss 122 to permit attachment of the panels together as a rectangular frame for the cabinet via screw holes 223. FIG. 11A further depicts an engaging structure 178 formed by a hook 170 that engages rail 172 and secured by a nut 174 for hanging the top inward edge of the panel 220 (and cabinet) against a mounting surface such as a wall 171A for a surface-mount installation (i.e. with the back of the case flush against the wall). FIG. 11C depicts bottom panel 230 with a securing bracket 278 that engages a lower inward edge of panel 230 (and the cabinet). Bracket 278 has an angled face 270 that is secured to the support structure 171A by screw 274, which may then be connected by a pivoting and locking cover flap 272.

Panels 220, 230, 240, upon assembly into a rectangular frame for the medicine cabinet, may be easily assembled into wider widths than conventional cabinets due to the horizontally extending screw bosses that increase the structural rigidity of the top and bottom panels.

Also, panels 220, 230, 240 are uniquely shaped and configured so that the assembled frame (and cabinet) may be easily inverted and mounted to a support structure (wall, etc.) using the same mounting hardware.

Further, panels 220, 230, 240 include front edge flanges 221, 231, 241 which permit the cabinet to be recess-mounted (e.g. within an appropriately sized opening in the wall), such that an inner face of flanges 221, 231, 241 abuts in a flush manner against the wall 171B adjacent to the opening.

Some embodiments relate to an improved method of installing a medicine cabinet. The method includes providing for a cabinet box that is configured to be mounted on a surface or within a recess. The method further includes providing a top panel or a bottom panel of the cabinet box with a bracket attached to the surface or within an interior of the recess. In addition, the method includes providing each of the top panel and the bottom panel with at least one screw boss that provides a stiffening support for the cabinet box. The method further allows for shelves to be inserted in the cabinet box without drilling holes in a wall. In at least one embodiment, the method provides for top slide clips to mount to the wall bracket such that a weight of cabinet holds a bottom of the cabinet against the wall, such as in the manner of a "French cleat" or the like. The method further provides for slide-in tabs with holes to be screwed to the wall that have snap covers to cover screws, concealing screws from view. The method provides for the cabinet box to be readily removable and for installation upside down as an opposite hand cabinet; i.e., the method permits the cabinet box to be installed such that a cabinet door opens leftward or rightward.

Figure 3:
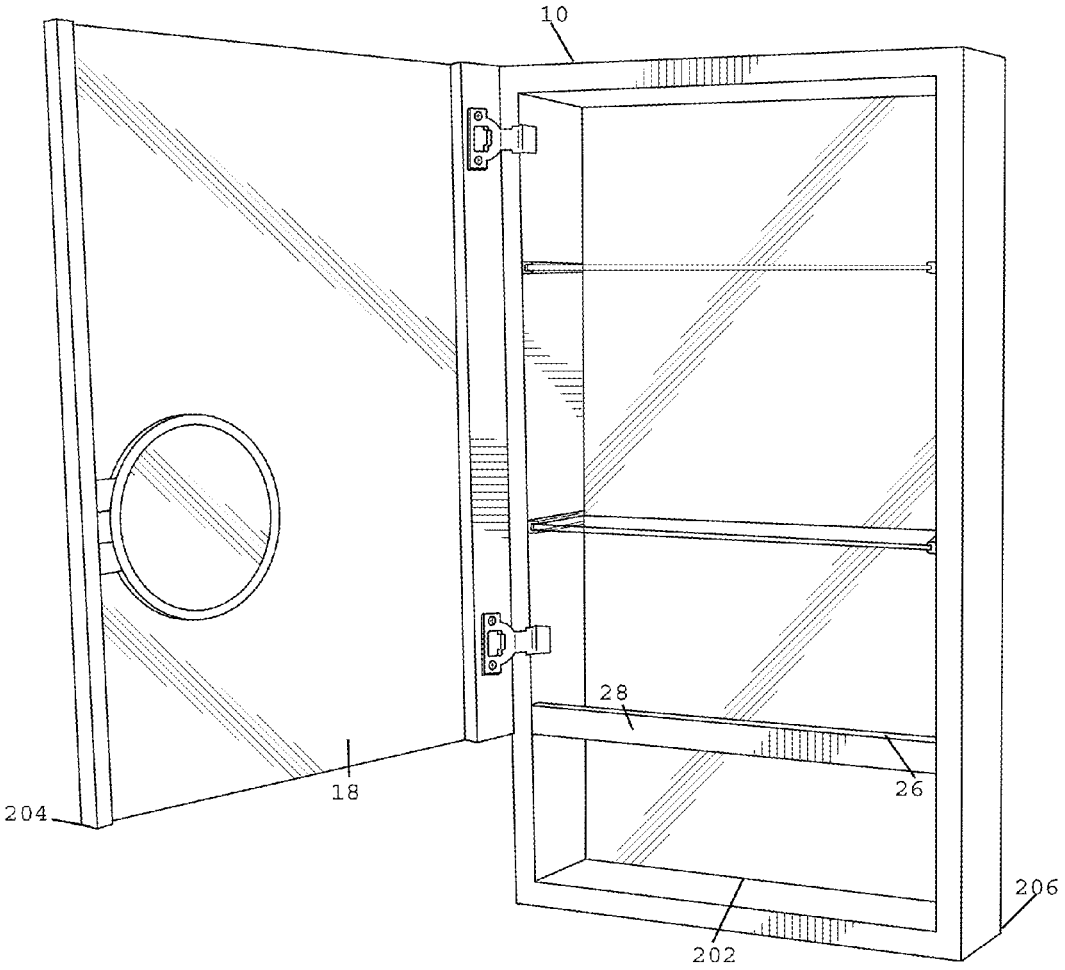
FIG. 3 is a perspective view of a medicine cabinet with an under-hanging shelf, according to an exemplary embodiment.

As shown now more particularly in FIG. 3, some embodiments may feature an underhanging shelf portion 202 of the cabinet box 10. Such embodiments include cabinet doors that are not equivalent in height to a height of the cabinet box. In other words, the height 204 of the door 18 may be shorter than a total height 206 of the box, leaving an exposed area defined by a shelf or compartment beneath a main body of the box. In some embodiments, display items or commonly utilized items may be placed in the underhanging shelf. FIG. 3 further depicts that the underhanging shelf 202 may exist in a cabinet box that also has the retaining shelf 26 with the retaining wall 28 to stow items securely. Such an embodiment permits some items to be displayed in the underhanging shelf and other items to be stored securely within the retaining shelf.

Figure 12:
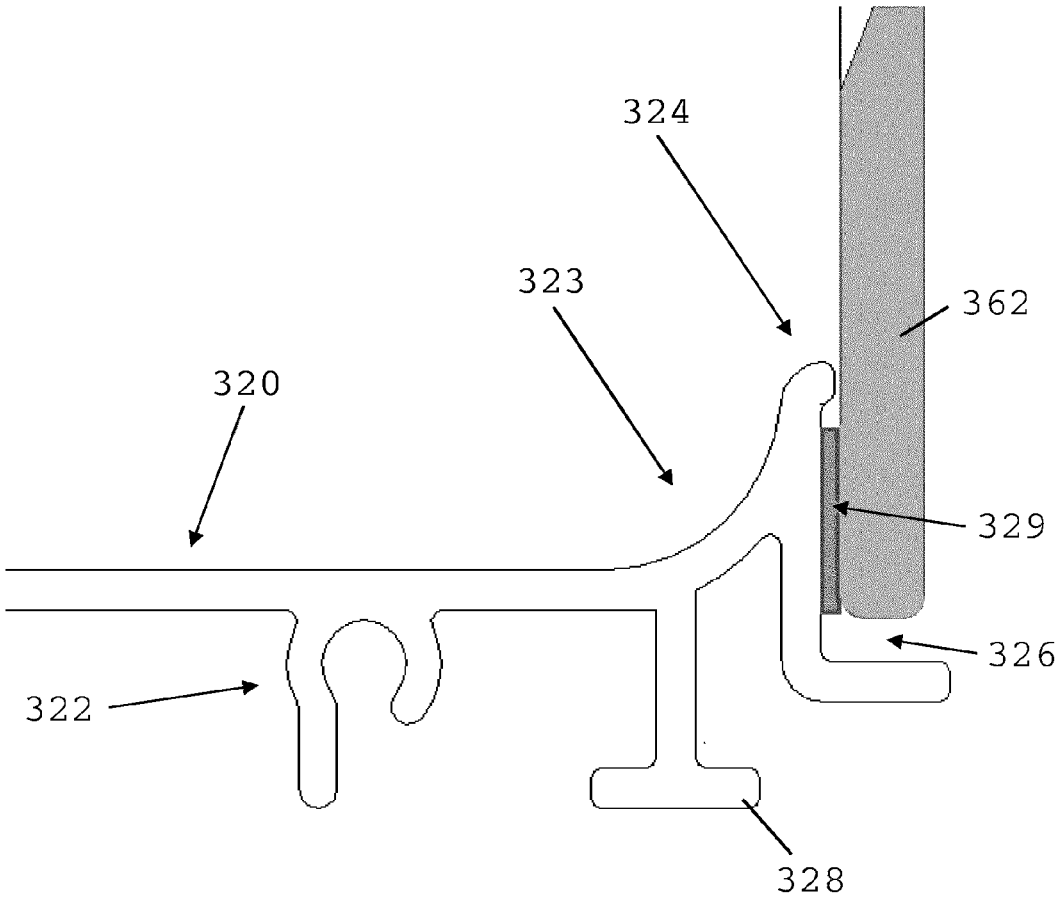
FIG. 12 is a bottom view of a cross-section of an adjustment mechanism in the medicine cabinet of FIG. 1.

Referring now to FIG. 12, a panel member for a frame of a medicine cabinet is shown according to another exemplary embodiment to include a clean corner configuration. The panel member 320 may be used for the top, bottom and both sides of the frame for the medicine cabinet and is shown to include any integrally formed screw boss 322 (such as previously described for improving the rigidity of the horizontal top and bottom panel members and for attaching the side panel members to the top and bottom members. Panel member 320 further includes a rounded corner 323 at the rear portion of the panel and cabinet, with a projecting sealing lip 324, a mounting ledge 326 for supporting a mirror panel 362 and a structure 328 for receiving a mounting bracket (e.g. of a type previously described with reference to FIGS. 11A-C). The ledge 326 may receive and secure the mirror panel 362 using a suitable adhesive 329 such as two-sided tape, etc. The sealing lip 324 is configured to minimize or prevent intrusion of debris or moisture against the mirror edge (e.g. to prevent formation of mildew, desilverization of the glass edges, etc.) This "clean corner" 323 is intended to make it easy for consumers to clean their medicine cabinets. The front lip extends over the mirror edge and has a recess in a ledge area for two-sided tape or other suitable adhesive material, thus allowing the mirror to be sealed against the lip and secured to the panel without the tape or adhesive being visible to a user.

Thus, the present invention provides improvements to a medicine cabinet with desired advantages, but without the undesired disadvantages. It should be appreciated that a preferred embodiment of the invention has been described above. However, many modifications and variations to this preferred embodiment will be apparent to those skilled in the art, which will be within the spirit and scope of the invention.

Therefore, the invention should not be limited to just the specifically described embodiments. To ascertain the full scope of the invention, the following claims should be referenced.

What is claimed:

1. A medicine cabinet comprising:

a cabinet box with a cabinet door, a top panel, a bottom panel, and two side panels joining the top panel and the bottom panel;

a plurality of shelves each configured to be inserted within the cabinet box between a pair of clips having an engagement structure that mates in a height-adjustable manner with a corresponding engagement structure disposed on or adjacent to the two side panels; and a magnifying mirror that selectively slides in a height-adjustable manner in a track along the cabinet door; the magnifying mirror being connected to the cabinet door with a bow clip, wherein the top panel and the bottom panel are interchangeable to permit the cabinet to be inverted for installation in an opposite hand configuration.

2. The cabinet of claim 1, wherein the magnifying mirror is to rotate between a stowed position that is flush along an interior side of the cabinet door and a deployed position.

3. The cabinet of claim 2, wherein the top panel and the bottom panel include a flange along a forward edge to permit the panels to be used to mount the cabinet box in a recess mount configuration, and a mounting bracket along a rearward edge to permit the panels to be used to mount the cabinet in a surface mount configuration.

4. The cabinet of claim 3, wherein the panels include at least one curved corner surface providing a lip configured to seal against a mirror.

5. The cabinet of claim 1, wherein the pair of clips are formed in a T shape and the corresponding engagement structure on the clips and the side panels are in the form of mating undulations.

6. The cabinet of claim 1, wherein at least the top panel and the bottom panel include a screw boss extending the length of the panel, the screw boss configured to permit attachment of the side panels to the top and bottom panels, and to provide increased stiffness along the length of the top and bottom panels.

7. A cabinet comprising:

a cabinet box comprising side panels and a top and bottom panel assembled to define a frame;

a cabinet door pivotally coupled to the frame;

the panels comprising a receptacle portion with internal projections, and a spaced apart lip;

a backboard having edges disposed within the receptacle portion and secured by the projections to form a back panel for the cabinet box;

a mirror panel having a peripheral edge area secured to the spaced apart lip on the panels, and at least one shelf configured to be adjustably installed within the cabinet box by a air or rotatable clips, the rotatable clips having a T shape with a head portion and a bottom portion, wherein the head portion comprises at least one undulation configured to removably engage corresponding undulations on a track disposed on or adjacent to the side panels, and wherein the body portion is configured to support an end of the shelf.

8. The cabinet of claim 7, further comprising an accessory mounted to the cabinet door in selectively slidable manner.

9. The cabinet of claim 8, wherein the accessory comprises a magnifying mirror coupled to one of a rail or a track on the cabinet door by an actuatable clip, the actuatable clip configured to grip the rail or track when not actuated to prevent sliding and configured to release the rail or track when actuated to permit sliding to adjust a position of the magnifying mirror along the cabinet door.

10. The cabinet of claim 9, wherein the magnifying mirror is movable between a stowed position adjacent an interior surface of the cabinet door, and a deployed position.

11. The cabinet of claim 7, wherein the clips are formed at least partially from translucent plastic.

12. The cabinet of claim 7, wherein the cabinet box extends below a lower edge of the cabinet door to provide an exposed storage area.

13. The cabinet of claim 7, wherein the top and bottom panels are substantially symmetric and are configured to mount the cabinet to a support surface in an upright or inverted orientation.

14. The cabinet of claim 13, wherein the top and bottom panels comprise a flange along a forward edge and a mounting bracket along a rearward edge, so that the cabinet box may be mounted to the support surface in a surface mount or recess mount configuration.

15. The cabinet of claim 7, wherein the mirror panel is secured to the lip by an adhesive material.

16. A cabinet comprising:

a cabinet box comprising side panels and a top and bottom panel assembled to define a frame;

a cabinet door pivotally coupled to the frame;

a magnifying mirror coupled to one of a rail or a track on the cabinet door by an actuatable clip, the actuatable clip configured to grip the rail or track when not actuated to prevent sliding and configured to release the rail or track when actuated to permit sliding to adjust a position of the magnifying mirror along the cabinet door.

17. The cabinet of claim 16, wherein the cabinet door comprises a hinge-side frame member and a free-side frame member that define a depth of the cabinet door, the free-side member comprising the rail or track to receive the actuatable clip.

18. The cabinet of claim 17, wherein the magnifying mirror is pivotable about the rail or track between a stowed position that is entirely within the depth of the cabinet door so that the magnifying mirror does not interfere with shelves in the cabinet box, and a deployed position disposed outwardly from the cabinet door.

* * * * *

UNITED STATES PATENT AND TRADEMARK OFFICE

CERTIFICATE OF CORRECTION

PATENT NO. : 9,211,004 B2
APPLICATION NO. : 13/804704
DATED : December 15, 2015
INVENTOR(S) : Diemel It is certified that error appears in the above-identified patent and that said Letters Patent is hereby corrected as shown below:

Specification

Column 6, line 11 “curved” should be “curve.”

Claims

Claim 7 – Column 2, line 8 “a air or” should be “a pair of,”

Signed and Sealed this
Tenth Day of May, 2016

Michelle K. Lee

Michelle K. Lee
*Director of the United States Patent and Trademark Office*